United States Patent [19]

Holland et al.

[11] 4,336,476

[45] Jun. 22, 1982

[54] GROOVED X-RAY GENERATOR

[75] Inventors: William P. Holland; Donld F. DeCou, Jr., both of West Redding, Conn.

[73] Assignee: The Machlett Laboratories, Incorporated, Stamford, Conn.

[21] Appl. No.: 96,867

[22] Filed: Nov. 23, 1979

Related U.S. Application Data

[63] Continuation of Ser. No. 939,566, Sep. 5, 1978, abandoned.

[51] Int. Cl.[3] ..... H01J 35/10

[52] U.S. Cl. ..... 313/60; 313/330

[58] Field of Search ..... 313/60, 330

[56] References Cited

U.S. PATENT DOCUMENTS

| | | | |
|---|---|---|---|
| 1,056,401 | 3/1913 | Caldwell | 313/330 X |
| 2,468,942 | 5/1949 | Oosterkamp et al. | 313/330 X |
| 3,286,112 | 11/1966 | Kitahama et al. | 313/60 X |
| 3,665,236 | 5/1972 | Gaines et al. | 313/55 |
| 3,683,223 | 8/1972 | Dietz | 313/60 |
| 3,942,015 | 3/1976 | Huxley | 313/60 X |
| 4,017,757 | 4/1977 | De Cou, Jr. | 313/330 X |

FOREIGN PATENT DOCUMENTS

| | | | |
|---|---|---|---|
| 956966 | 1/1957 | Fed. Rep. of Germany | 313/60 |
| 1200962 | 9/1965 | Fed. Rep. of Germany | 313/60 |

OTHER PUBLICATIONS

"Electron Gun For Generating X-rays", by M. B. Heritage et al., *IBM Technical Disclosure Bulletin,* vol. 17, No. 6, Nov. 1974, p. 1823.

*Primary Examiner*—Palmer C. Demeo

*Attorney, Agent, or Firm*—John T. Meaney; Joseph D. Pannone

[57] ABSTRACT

An X-ray tube comprising a tubular envelop having rotatably mounted therein an anode target disc provided with a peripheral rim surface wherein a focal track groove is disposed, the groove including a focal spot area spaced from an electron emitting cathode which is associated with a beam-forming structure including an X-ray transparent window in a portion of the envelope aligned with the focal spot area.

16 Claims, 16 Drawing Figures

GROOVED X-RAY GENERATOR

CROSS-REFERENCE TO RELATED CASES

This is a continuation of application Ser. No. 939,566, filed Sept. 5, 1978, and now abandoned.

BACKGROUND OF THE INVENTION

1. Field of the Invention

This invention relates generally to X-ray generators, and is concerned more particularly with an X-ray tube having a rotating anode provided with a peripheral groove focal track.

2. Discussion of the Prior Art

Generally, an X-ray tube of the rotating anode type comprises a tubular envelope having therein an anode target disc which is axially rotatable and provided with a radially sloped, annular focal track adjacent its periphery. A rectangular focal spot area disposed radially on the focal track usually is axially aligned with a linear filamentary cathode, and is radially aligned with an X-ray transparent window in the tube envelope. Due to the rotation of the anode target disc, the material of the focal track in the focal spot area is constantly changing in order to provide greater heat dissipation than X-ray tubes of the stationary anode type.

In operation, the cathode thermionically emits electrons which are electrostatically beamed onto the focal spot area with sufficient energy to generate X-rays. A useful portion of the X-rays radiating from the focal spot area pass in a divergent beam from the tube through the X-ray transparent window in the tube envelope. However, because the window is radially aligned with the focal spot area, the X-ray beam appears to be emanating from a radial projection of the focal spot area, which generally is referred to as the "effective" focal spot of the tube.

An edge portion of the beam emanating from the "effective" focal spot extends along the sloped surface of the focal spot area and, consequently, acquires a number of characteristics traceable to what may be termed as the "heel effect". For example, this edge portion of the X-ray beam, as compared to other portions thereof, appears to be emanating from a focal spot of radically different size and configuration, thereby degrading uniformity of resolution in a radiograph produced by the X-ray beam. Also, due to the filtering properties of the sloped target surface, which increase rapidly with aging, the adjacent edge portion of the beam has a lower X-ray intensity and a higher percentage of "hard" X-rays than other portions of the X-ray beam. As a result, the aligned portion of the radiograph exhibits a different quality of definition and contrast as compared with other portions of the radiograph.

Therefore, it is advantageous and desirable to provide an X-ray tube of the rotating anode type with an anode target having focal track means for producing an X-ray beam which does not have the undesirable characteristics traceable to the roughened surface of conventional anode target focal tracks.

SUMMARY OF THE INVENTION

Accordingly, this invention provides an X-ray tube of the rotating anode type comprising a tubular envelope wherein an anode target disc is rotatably mounted and includes a peripheral rim surface having disposed therein a focal track groove provided with defining surfaces of suitable X-ray emitting material, such as tungsten, for example. Thus, the entire disc may be made of the X-ray emitting material and have the focal track groove disposed in the peripheral rim surface thereof. Alternatively, the disc may be made of a relatively lighter weight material, such as graphite, for example, and include a peripheral rim surface having therein a focal track groove, the surfaces of which are coated, as by chemical vapor deposition, for example, with the X-ray emitting material. Furthermore, the X-ray emitting material defining the focal track groove may be provided with an overlayer of more ductile material, such as rhenium or an alloy of rhenium and tungsten, for examples. The focal track defined by the X-ray emitting material may have any cross-sectional configuration desired, such as V-shaped or U-shaped, for examples, and preferably is symmetrical with respect to a centerline extending into the opening of the groove.

The focal track groove includes a focal spot area thereof aligned with an X-ray transparent window in the tube envelope, such that a divergent X-ray beam emanating from the focal spot area passes through the window and out of the tube. Disposed adjacent a peripheral portion of the window is an electron emitting cathode insulatingly supported within a grid channel member having an opening therein directed radially inward of the window. Preferably, the cathode is shielded from the X-ray beam emanating from the focal spot area by the grid channel structure, which may serve to collimate the X-ray beam and absorb off-focus X-radiation. Also, the X-ray transparent window preferably is made of electrically conductive material, such as beryllium, for example, and is electrically attached to the grid channel member to form therewith an electron focusing structure.

In operation, the anode target disc is rotated to move the X-ray emitting material of the focal track through the focal spot area aligned with the window at a suitable speed; and the cathode is heated electrically to a desired electron emitting temperature. The grid channel member is maintained at a suitable electrical potential, with respect to the cathode, for repelling electrons back thereto or directing them out of the opening in the channel member, as desired. The grid channel member and the electrically conductive window constitute an electron focusing structure which is shaped to direct electrons emerging from the opening onto a focal spot area of the desired size and configuration. The anode target disc is maintained at a suitably high positive potential, with respect to the cathode, for beaming the focused electrons onto the focal spot area with sufficient kinetic energy to generate X-rays which radiate from the focal spot area. The resulting X-ray beam emanating from the focal spot area in the focal track groove and passing through the radially aligned window in the tube envelope exhibits more uniform intensity and resolution characteristics than an X-ray beam emanating from a similar focal spot on a sloped focal track of a conventional anode target disc.

BRIEF DESCRIPTION OF THE DRAWINGS

For a better understanding of this invention, reference is made in the following more detailed description to the accompanying drawings wherein.

DESCRIPTION OF THE PREFERRED EMBODIMENTS

Figure 1:
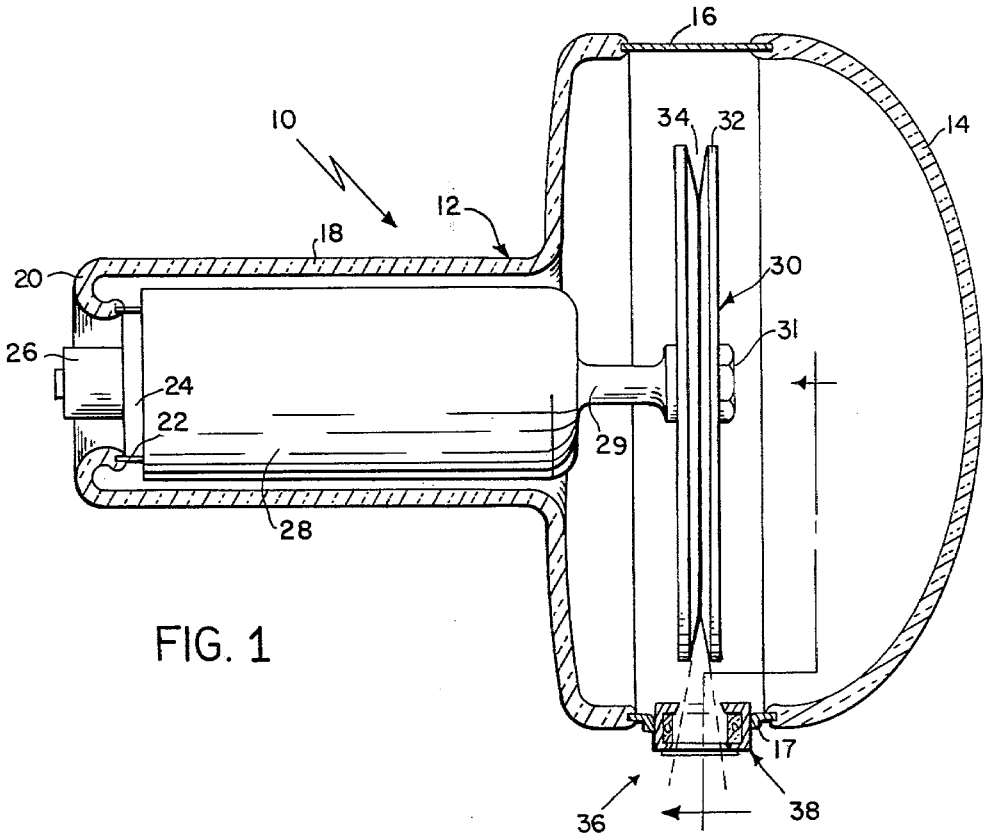
FIG. 1 is an axial view, partly in section, of a rotating anode type of X-ray tube embodying the invention.

Referring to the drawings wherein like characters of reference designate like parts, there is shown in FIG. 1 an X-ray tube 10 of the rotating anode type including an evacuated tubular envelope 12. Envelope 12 may be provided with a dome-like end portion 14 made of dielectric vitreous material, such as glass, for example, which is peripherally sealed in a conventional manner to an end portion of an axially aligned sleeve 16. The sleeve 16 preferably is made of metallic material, such as Kovar, for example, and has an opposing end portion peripherally sealed to an inwardly flared portion of envelope 12. The inwardly flared portion is made of dielectric vitreous material, such as glass, for example, and is integrally joined to a reduced diameter end portion 18 of the envelope. Reduced diameter portion 18 terminates at the other end of envelope 12 in a reentrant portion 20 which is peripherally sealed through a collar 22 made of suitable metallic material, such as Kovar, for example, to an outer cylindrical surface of a stationary housing 24.

The housing 24 is made of electrically conductive material, such as copper, for example, and has an adjacent closed end provided with an externally extending stem 26 which constitutes the anode terminal of tube 10. Housing 24 is provided with axially spaced bearings (not shown) which rotatably support, in a well-known manner, a skirt-type rotor 28 made of electrically conductive material, such as copper, for example. The rotor 28 is axially disposed within reduced diameter end portion 18 of envelope 12 which is encircled by an electrical stator (not shown) of an induction-type motor to rotate the rotor 28 about its axial centerline at a predetermined velocity. Fixedly attached to the inner end of rotor 28 is an electrically conductive stem 29 which extends axially through an anode target disc 30. The stem 29 is secured in an electrically conductive manner to target disc 30 by conventional means, such as nut 31 threadingly engaging a protruding end portion of the stem 29, for example. Target disc 30 is transversely disposed within the sleeve 16 and has an outer peripheral rim surface 32 insulatingly spaced therefrom. Thus, the target disc 30 is electrically connected through the described anode structure to the terminal 26 of tube 10, and is axially rotated within the radially spaced sleeve 16 by the rotor 28.

Colinearly disposed in the peripheral rim surface 32 is an arcuate opening of a focal track groove 34 which extends radially to a predetermined depth in the body of target disc 30. Groove 34 preferably is continuous and extends annularly about the axial centerline of disc 30. In the radial direction, the groove 34 may have a V-shaped cross-sectional configuration with an opening disposed in the rim surface 32 and radially tapering wall surfaces which join one another in the body of target disc 30. Alternatively, the groove 34 may have any other radial cross-sectional configuration, such as U-shaped, for example, which is suitable for generating an X-ray beam. The defining wall surfaces of groove 34 are made of a suitable X-ray emissive material, such as tungsten, for example, which may comprise the material of target disc 30 or may comprise a focal track layer of material deposited on the walls of groove 34. The arcuate opening of groove 34 has a portion disposed in radially opposed relationship with a spaced beam-forming structure 36 hermetically sealed in the sleeve 16 of envelope 12.

Figure 2:
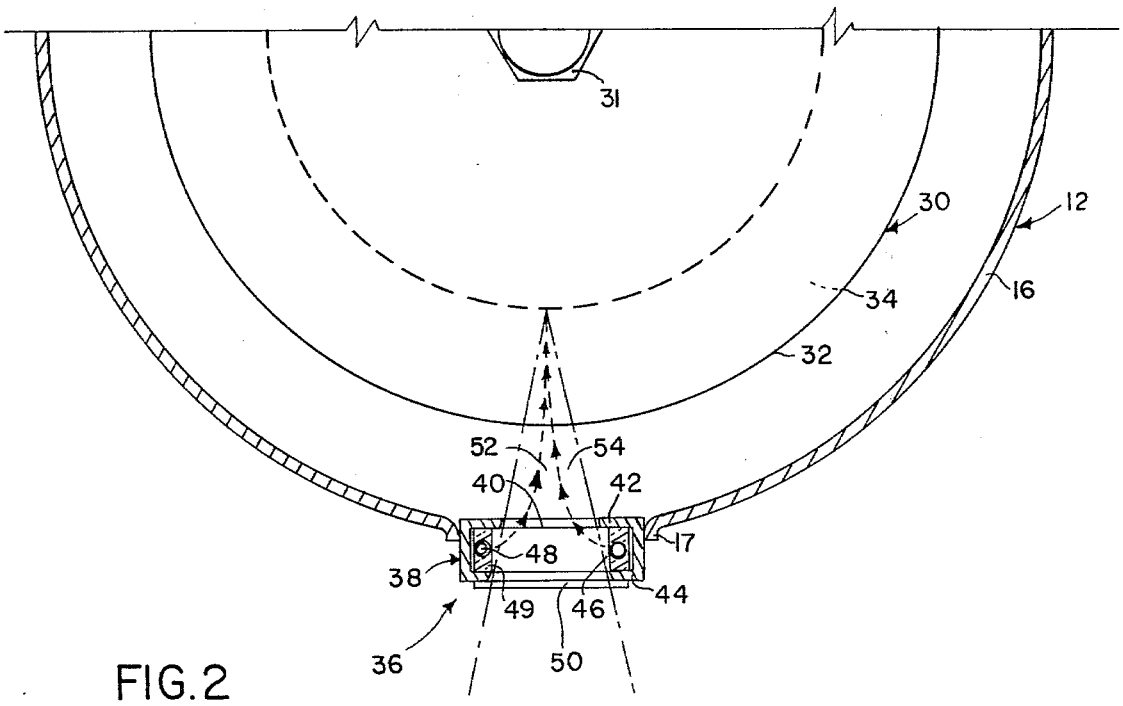
FIG. 2 is a fragmentary transverse view taken along the line 2—2 shown in FIG. 1 and looking in the direction of the arrows.

Extended radially through the sleeve 16 of envelope 12, as shown more clearly in FIG. 2, is an aperture having a rim flange 17 which may encircle an inserted plug-like structure 36. The structure 36 includes an annular grid member 38 having an outer cylindrical surface peripherally attached, as by welding, for example, to the flange 17. Grid member 38 is made of suitable electrically conductive material, such as Monel, for example, and defines a beam-shaping aperture 40 which is radially aligned with an arcuate open portion of focal track groove 34. The grid member 38 is provided with spaced inner and outer wall portions, 42 and 44, respectively, which form an interposed channel means 46 having an opening disposed adjacent the beam-shaping aperture 40. Within channel means 46, an electron emitting cathode 48 is insulatingly supported by any convenient means, such as extending filamentary cathode 48 longitudinally through holes provided in spaced dielectric posts 49 which are suitably secured in the channel, for example. The radially outer end of beam-shaping aperture 40 is closed by a transversely disposed, X-ray transparent window 50 made of electrically conductive material, such as beryllium, for example. Window 50 is hermetically attached to the adjacent surface of grid member 38 in an electrically conductive manner, such as brazing, for example.

In operation, filamentary cathode 48 is maintained at a desired reference potential, such as ground, for example, and is electrically heated to emit a copious supply of electrons. The annular grid member 38 and electrically connected window 50 are biased, with respect to the cathode reference potential, at a suitable electron repelling potential for focusing electrons emitted from cathode 48 into a beam 52 which is directed onto a focal spot area of groove 34. Anode disc 30 is rotated at a desired velocity and is maintained, with respect to the cathode reference potential, at an electron accelerating potential to provide the impinging electrons with sufficient kinetic energy for generating X-rays in the surface material of the focal spot area in groove 34. As a result, an X-ray beam 54 emanates from the focal spot area of groove 34 and travels through the beam-shaping aperture 40 to pass through the X-ray transparent window 50. Accordingly, the X-ray beam 54 may be considered to be emanating from a radial projection of the focal spot area, generally referred to as the "effective" focal spot 56 of the X-ray tube.

As shown in FIGS. 3 and 4a–4c, the beam-forming structure 36 may comprise a toroidal grid member 38a having spaced inner and outer wall portions 42a and 44a, respectively, which are circular and extend radially inward of the member 38a. Wall portions 42a and 44a form an interposed continuous channel 46a which is open toward a central beam-shaping aperture 40a defined by the spaced wall portions 42a and 44a. Preferably, the radial extent of inner wall portion 42a is greater than that of outer wall portion 44a to provide aperture 40a with a generally frusto-conical configuration having a large diameter end adjacent window 50. Beam-shaping aperture 40a is aligned with an arcuate open portion of the focal track groove 34, which may have a radially V-shaped cross-sectional configuration. Insulatingly supported in the channel 46a, as by dielectric posts 49, for example, is an arcuate cathode filament 48a having spaced end portions electrically connected to respective terminals 57a and 58a. The terminals extend hermetically and insulatingly through grid member 38a, as by dielectric bushings 61, for example, to provide means for electrically connecting the filament 48a to a suitable electrical current source (not shown). Electrically attached to the outer cylindrical surface of member 38a is a grid terminal 62 which provides means for electrically connecting the member 38a and window 50 to a biasing voltage source (not shown).

Figure 3:
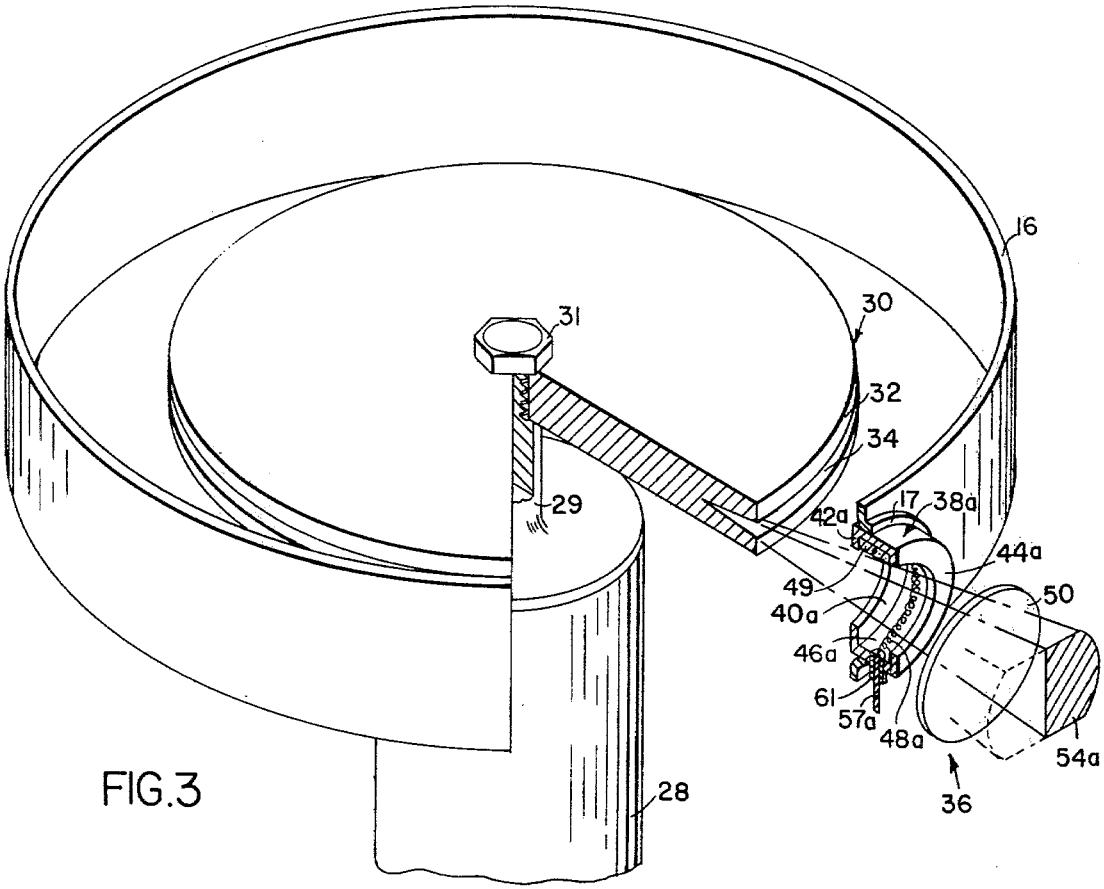
FIG. 3 is a fragmentary isometric view of the tube shown in FIG. 1 to illustrate operation of the invention.
Figure 4A:
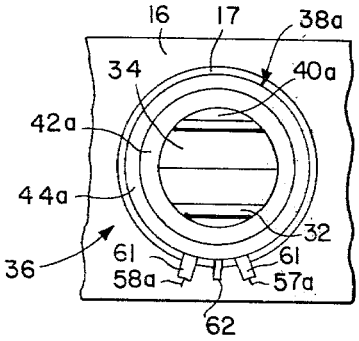
FIGS. 4*a*–4*c* are fragmentary elevational views showing one configuration of the grid member, the cathode, and the resulting focal spot, respectively.
Figure 4B:
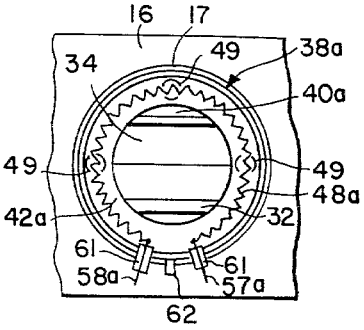
Figure 4C:
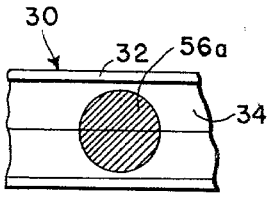

Thus, in operation, the grid member 38a and window 50 may be biased electrically negative with respect to filament 48a, and focus electrons emitted therefrom into a generally conical beam which impinges on an aligned focal spot area of groove 34. Preferably, at the opening of groove 34, the electron beam has a cross-sectional configuration which is substantially circular and has a diametric size less than the transverse width of groove 34. Accordingly, all of the beamed electrons may be directed into the groove 34 and impinge on a focal spot area having a radial projection of substantially circular configuration at the opening of the groove. As a result, the X-ray beam 54a egressing through window 54 may be considered as emanating from an "effective" focal spot 56a having a substantially circular configuration, as shown in FIG. 4c. The X-ray beam 54a may be generally conical and have a substantially circular, cross-sectional configuration determined by the toroidal grid member 38a defining beam-shaping aperture 40a. However, if the groove 34 is relatively deep as compared to its transverse width, the grid member 38a may collimate the X-ray beam 54a only in the plane parallel to the target disc 30. The plane of the X-ray beam 54a perpendicular to the target disc 30 may be collimated by the radially extended walls of groove 34, as shown in FIG. 3. In that instance, the X-ray beam 54a egressing through window 50 may be generally fan-shaped and have an included angle, such as one hundred and twenty degrees, for example, determined by the diameter of beam-shaping aperture 40a, in the plane of groove 34.

Alternatively as shown in FIGS. 5a–5d, the beam-shaping structure 36 may include an annular grid member 38b made of electrically conductive material and having an outer cylindrical surface peripherally attached to the flange 17. The grid member 38b has a rectangular central aperture 40b aligned with an arcuate open portion of groove 34 and having an outer end closed by the hermetically sealed window 50 made of electrically conductive material. Aperture 40b constitutes the beam-shaping aperture of the structure and, preferably, has a substantially square configuration. A lateral side of the aperture 40b is defined by respective edges of spaced inner and outer wall portions 42b and 44b, which form an interposed linear channel 46b having a U-shaped cross-section open toward the aperture 40b. The opposing side of aperture 40b is defined by respective edges of spaced inner and outer wall portions 41b and 43b, which form an interposed linear channel 45b having a U-shaped cross-section open toward aperture 40b. Preferably, the respective inner walls 41b and 42b extend inwardly of the member 38b a greater distance than the respective outer walls 43b and 44b to provide the aperture 40b with a generally frusto-pyramidal configuration.

Insulatingly supported, as by dielectric posts 49, for example, within the channels 45b and 46b are respective colinear filaments 47b and 48b. The filament 48b, preferably, may have a greater linear extension within the channel 46b than the filament 47b has within the channel 45b. End portions of the filament 47b are electrically connected to respective terminals 57b and 59b which extend hermetically and insulatingly, as by dielectric bushings 61, for example, through the grid member 38b. Similarly, end portions of the filament 48b are electrically connected to respective terminals 58b and 60b which extend hermetically and insulatingly through the wall of grid member 38b. The terminals 57b–60b provide means for electrically connecting the filaments 47b and 48b to respective external sources (not shown) of electrical heating current. Also, attached to an external surface of grid member 38b is a terminal 62 which provides means for connecting the member 38b and electrically attached window 50 to a biasing voltage source (not shown).

Figure 5A:
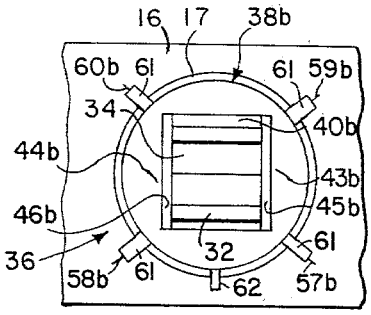
FIGS. 5*a*–5*d* are fragmentary elevational views showing an alternative configuration of the grid member, the cathode, and the resulting focal spots, respectively.
Figure 5B:
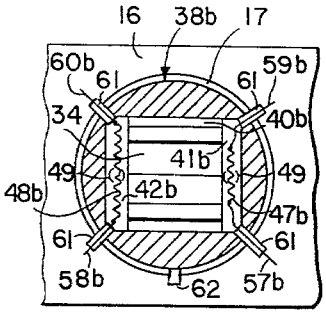
Figure 5C:
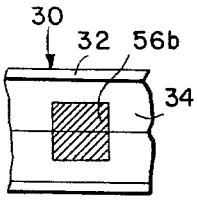
Figure 5D:
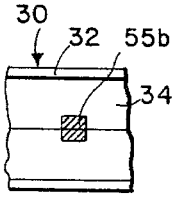

Thus, the grid member 38b and window 50 may be biased electrically with respect to filament 47b and focus electrons emitted therefrom onto a suitable focal spot area of groove 34 for producing an "effective" focal spot 55b having a generally rectangular configuration, as shown in FIG. 5d. Preferably, the "effective" focal spot 55b is substantially square and is maintained as small as possible to approximate a point source of X-radiation. Accordingly, the resulting X-ray beam, which may be considered to be emanating from the "effective" focal spot 55b provides high resolution for imaging fine detail body structure, such as small blood vessels, for example.

Also, the grid member 38b and window 50 may be biased electrically with respect to filament 48b and focus electrons emitted therefrom onto a relatively larger focal spot area of groove 34 to produce a correspondingly larger "effective" focal spot area 56b having a generally rectangular configuration, as shown in FIG. 5c. Preferably, the "effective" focal spot 56b is substantially square and is spread over as large a focal spot area of groove 34 as feasible. Accordingly, the resulting X-ray beam provides sufficient flux density for irradiating a relatively large area in situations where high resolution is not regarded as being of prime importance.

Figure 7A:
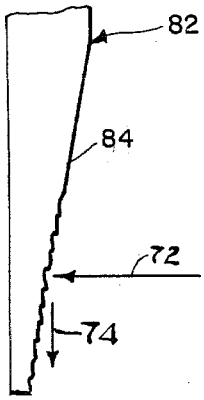
FIG.7a PRIOR ART
FIGS. 7*a*–7*c* are fragmentary schematic views of a conventional X-ray target disc and illustrating the problems of non-uniform X-ray quality, intensity, and resolution characteristics, respectively, solved by this invention.
Figure 7B:
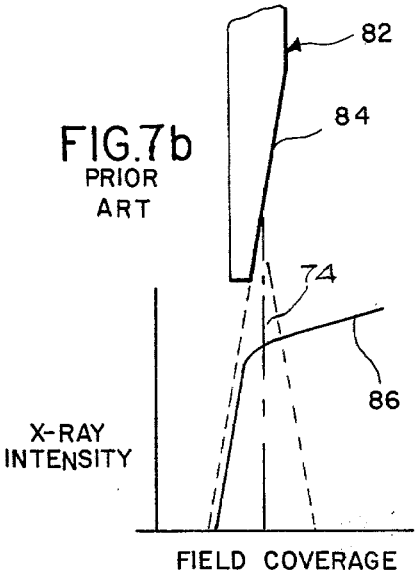
FIG.7b PRIOR ART

In FIG. 7a, there is shown a prior art type of rotating anode target comprising a disc 82 having adjacent it outer periphery a radially sloped surface 84 which constitutes the focal track surface of the target. An axially directed electron beam 72 impinges on the focal track surface 84 and generates a radially directed beam 74 of useful X-rays. However, the impinging electrons eventually pit the focal track surface 84 and produce valleys wherein the X-rays are generated. Consequently, X-rays in the portion of beam 74 adjacent the focal track surface 84 are required to pass through interposed crests of target material. As a result, the portion of X-ray beam 74 adjacent focal track surface 84 exhibits a "heel" effect comprising a lower X-ray intensity and a higher percentage of "hard" X-rays as compared to other portions of the beam. The characteristic decrease in X-ray intensity due to the "heel" effect is shown in FIG. 7*b* by the steep gradient in the portion of curve 86 aligned with the slope of focal track surface 84.

Figure 6A:
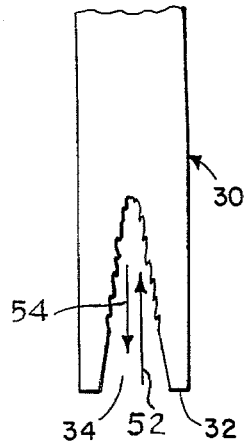
FIGS. 6*a*–6*c* are fragmentary schematic views of the X-ray target disc shown in FIGS. 1–3 and illustrating the improvement provided in the X-ray quality, intensity, and resolution characteristics respectively, of the beam produced.
Figure 6B:
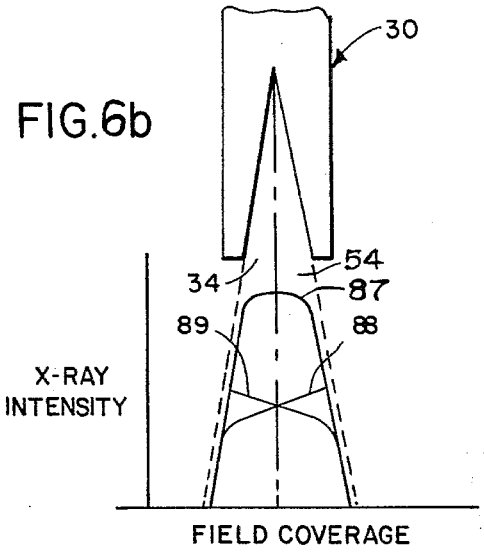

On the other hand, as shown in FIG. 6*a*, the electron beam 52 directed into groove 34 generates an X-ray beam 54 which emerges from groove 34 along the same general line of travel as the electron beam 52. Consequently, the electrons impinging on the target surfaces of groove 34 produce valleys wherein X-rays are generated, and crests of target material which are aligned generally with the paths of emerging X-rays. As a result, portions of the X-ray beam adjacent the sloped target surfaces of groove 34 do not have an unusually high percentage of "hard" X-rays as compared to other portions of the beam 54. Also, as shown in FIG. 6*b*, any decrease in X-ray intensity due to the "heel" effect on one surface of groove 34, such as evidenced by the steep gradient of curve 88, for example, is compensated by an increase in X-ray intensity from the other surface of groove 34, as evidenced by the upward sloping portion of curve 89, for example. The additive effect of both sloped surfaces of groove 34 may be shown by a resultant curve 87, which indicates that the X-ray beam 54 has a greater X-ray intensity and a more uniform distribution than the X-ray beam 74 from target disc 82. Accordingly, for X-ray imaging purposes, the X-ray beam 54 produced by target disc 30 will provide greater contrast than the X-ray beam 74 produced by target disc 82.

Figure 7C:
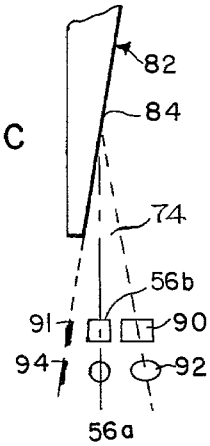
FIG.7c PRIOR ART

As shown in FIG. 7*c*, the X-ray beam 74 may be considered as emanating from a substantially square "effective" focal spot 56*b* only along a line projecting radially from the focal spot area on sloped target surface 84 of disc 82. With increasing angular distance away from the sloped surface 84, the "effective" focal spot 56*b* becomes elongated and may take on the appearance of rectangle 90, for example. Similarly, the circular "effective" focal spot 56*a* becomes elongated and may take on the appearance of ellipsoid 92, for example. With increasing angular travel toward the sloped surface 84, the square and circular "effective" focal spots, 56*b* and 56*a*, respectively, may reduce to lines 91 and 94, respectively, for example.

Figure 6C:
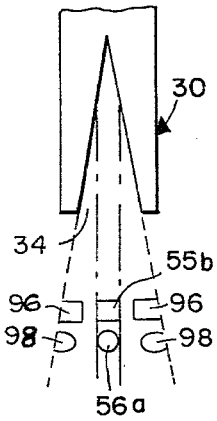

As shown in FIG. 6*c*, the X-ray beam 54 may be considered as emanating from respective square and circular "effective" focal spots 56*b* and 56*a* along a radially projecting central portion of the groove 34. With increasing angular distance, in either direction away from the radially projected central portion, the focal spots become slightly elongated and may appear as a rectangle 96 and an ellipsoid 98, respectively. However, these relatively slight variations in the configuration of the "effective" focal spot are not as extreme as the variations in the configuration of the "effective" focal spot shown in FIG. 7*c*. Accordingly, for X-ray imaging purposes, the X-ray beam emanating from focal track groove 34 provides more uniform resolution than the X-ray beam 74 emanating from the focal track surface 84 of prior art target disc 82.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. An X-ray target of the rotating type comprising:

a disc provided with an outer peripheral rim surface having therein a focal track groove; and a focal area means therein including inwardly extended wall surfaces of the groove for producing an X-ray beam having substantially uniform intensity in a plane perpendicular to the groove.

2. An X-ray target as set forth in claim 1 wherein the focal track groove is colinearly disposed in the rim surface.

3. An X-ray target as set forth in claim 2 wherein the focal track groove is continuous and annularly disposed about the axial centerline of the disc.

4. An X-ray target as set forth in claim 1 wherein the focal track groove has radially merged, wall surfaces.

5. An X-ray target as set forth in claim 4 wherein the focal track groove has a generally V-shaped, radial cross-sectional configuration.

6. An X-ray tube of the rotating anode type comprised of:

a tubular envelope;

an anode target disc rotatably supported within the envelope and including an outer rim surface having radially disposed therein a focal track groove provided with focal area means including a pair of opposing inwardly extended wall surfaces of X-ray emitting material for having X-ray emitting deficiencies of one of the wall surfaces compensated by X-ray emitting characteristics of the other wall surface; and beam-forming means attached to the envelope and aligned with a portion of the focal track groove for directing an electron beam into the groove and generating an X-ray beam.

7. An X-ray tube as set forth in claim 6 wherein the focal track groove is continuous and annularly disposed about the axial centerline of the target disc.

8. An X-ray tube as set forth in claim 6 wherein the surfaces of X-ray emitting material comprise opposing longitudinal sides of the focal track groove and merge with one another within the target disc.

9. An X-ray tube as set forth in claim 6 wherein the beam-forming means includes an annular grid member having a beam-shaping aperture axially disposed therein.

10. An X-ray tube as set forth in claim 9 wherein the grid member has an electron beam exit end portion disposed adjacent the focal track groove, and an opposing X-ray beam exit end portion.

11. An X-ray tube as set forth in claim 10 wherein the grid member includes channel means having insulatingly disposed therein the electron emitting cathode and having an opening disposed adjacent the beam-shaping aperture.

12. An X-ray tube as set forth in claim 11 wherein the beam-shaping aperture is circular and the electron emitting cathode is arcuate.

13. An X-ray tube as set forth in claim 11 wherein the beam-shaping aperture is rectangular and the electron emitting cathode is linearly disposed adjacent opposing sides of the beam-shaping aperture.

14. An X-ray tube as set forth in claim 11 wherein the grid member is provided with terminal means for having an electron repelling potential applied thereto with respect to the electron emitting cathode.

15. An X-ray tube as set forth in claim 14 wherein the beam-shaping means includes an X-ray transparent window made of electrically conductive material and sealed over the X-ray exit end portion of the grid member in an electrically conductive manner.

16. An X-ray target comprising:

a body of rigid material disposed about a central axis, the body having first and second surfaces made of X-ray emissive material and defined by respective first and second frusto-conical portions having axes coinciding with said central axis.

* * * * *